US005853806A

United States Patent [19]

Higuchi et al.

[11] Patent Number: 5,853,806

[45] Date of Patent: Dec. 29, 1998

[54] PROCESS FOR HOT DIP-COATING STEEL MATERIAL WITH MOLTEN ALUMINUM ALLOY BY ONE-STAGE COATING METHOD USING FLUX AND BATH OF MOLTEN ALUMINUM ALLOY METAL

[75] Inventors: Seijun Higuchi; Shigeru Nakano; Toshiyuki Aishima, all of Tokyo, Japan

[73] Assignee: Nihon Parkerizing Co., Ltd., Tokyo, Japan

[21] Appl. No.: 822,762

[22] Filed: Mar. 24, 1997

Related U.S. Application Data

[63] Continuation of Ser. No. 577,371, Dec. 22, 1995, abandoned.

[30] Foreign Application Priority Data

Jan. 10, 1995 [JP] Japan ..... 7-018507
Apr. 10, 1995 [JP] Japan ..... 7-109105

[51] Int. Cl.[6] ..... B05D 3/04

[52] U.S. Cl. ..... 427/310; 427/329; 427/431; 427/433; 427/436

[58] Field of Search ..... 427/310, 329, 427/431, 433, 436

[56] References Cited

U.S. PATENT DOCUMENTS

| | | | |
|---|---|---|---|
| 3,740,275 | 6/1973 | Heins | 148/26 |
| 3,860,438 | 1/1975 | Shoemaker | 117/50 |
| 4,496,612 | 1/1985 | McNutt et al. | 427/310 |
| 4,505,958 | 3/1985 | Lieber et al. | 427/433 |
| 4,738,758 | 4/1988 | Renaux et al. | 204/38.5 |
| 4,891,274 | 1/1990 | Higuchi et al. | 428/653 |

FOREIGN PATENT DOCUMENTS

| | | | |
|---|---|---|---|
| 904675 | 10/1986 | Belgium . | |
| 294509 | 10/1991 | German Dem. Rep. | C23C 2/02 |
| 58-136759 | 8/1983 | Japan | C23C 1/12 |
| 1-263255 | 10/1989 | Japan . | |
| 1-283353 | 11/1989 | Japan | C23C 2/30 |
| 3-094050 | 4/1991 | Japan | C23C 2/02 |
| 3-162557 | 7/1991 | Japan . | |
| 4-176852 | 6/1992 | Japan . | |
| 4-191355 | 7/1992 | Japan . | |
| 4-202751 | 7/1992 | Japan . | |
| 4-323356 | 11/1992 | Japan . | |
| 4323356 | 11/1992 | Japan | C23C 2/30 |
| 1057188 | 2/1967 | United Kingdom . | |

*Primary Examiner*—Benjamin Utech
*Attorney, Agent, or Firm*—Armstrong, Westerman, Hattori, McLeland & Naughton

[57] ABSTRACT

Disclosed are a process for hot-dip coating a steel material with a molten aluminum alloy according to a one-stage coating method using a flux which comprises removing an oxide layer on a steel material surface, conducting activating treatment, then coating a chloride flux solution and dipping the steel material in a molten aluminum alloy coating bath floated a fluoride-containing flux, thereby coating the steel material surface with aluminum alloy, or comprises removing an oxide layer on a steel material surface, adjusting surface roughness, conducting activating treatment and dipping the steel material in a molten Al—Zn—Si alloy or Al—Si alloy coating bath floated a flux added an iron component, thereby coating the steel material surface with Al—Zn—Si alloy or Al—Si alloy to adhere a large amount thereof and a aluminum alloy coating bath.

4 Claims, No Drawings

PROCESS FOR HOT DIP-COATING STEEL MATERIAL WITH MOLTEN ALUMINUM ALLOY BY ONE-STAGE COATING METHOD USING FLUX AND BATH OF MOLTEN ALUMINUM ALLOY METAL

This application is Continuation of application Ser. No. 08/577,371 filed Dec. 22, 1995, abandoned.

BACKGROUND OF THE INVENTION

1) Field on the Invention

The present invention relates to a process for coating a steel material, such as ferrous articles by the molten metal dip method with a molten aluminum alloy including a molten Al—Si alloy and a molten Al—Zn—Si alloy. Specifically, the process makes possible to form a smooth appearance of the coating layer which is substantially free from coating defects and oxides, and providing excellent coating performance and furthermore to adhere a heavy coating weight of aluminum alloy in the coating layer and a bath of molten aluminum alloy metal used in the process.

2) Prior Art

Hitherto, as an methods for improving corrosion resistance for building construction such as iron tower, bridge, etc., line hardware or bolt products as combination members thereof, etc., hot dip-galvanized coating has been conducted. However, with development of ocean and coast regions, various maintenances are required under severe circumstances for corrosion since when a hot dip-galvanized steel material is used for a long time, sufficient corrosion resistance cannot be obtained. Moreover, recently, problems from acid rain occur. Therefore, for steel materials as the above-mentioned use, a hot dip-coating with an aluminum alloy such as Al—Zn—Si alloy, Al—Si alloy, etc., is very effective. Various coating processes thereof have been investigated.

However, under the present situation, for building construction, line hardware and bolt products in which it is required to conduct hot dip-coating using a flux in the atmosphere, in a coating process with an alloy containing a large amount of aluminum such as Al—Zn—Si alloy, Al—Si alloy, etc., it is very difficult to obtain a coating layer having no coating defects, oxides, etc., and presenting uniform and smooth plated appearance and providing excellent coating performances as in hot dip-galvanized coating since aluminum is readily oxidized. Therefore, after conducting hot dip-galvanized coating to form a Fe—Zn alloy coating layer as in JP-A-1-263255 and JP-A-4-176852 or after conducting electroplating with Zn or Zn—Ni alloy as in JP-A-4-191355, two-stages coating methods to conduct molten Al—Zn alloy coating have been developed. However, in the two-stages coating methods, two pots for molten Zn and molten Al—Zn, or both an electroplating apparatus and a pot for molten Al—Zn are required, and furthermore there occurs the problems for increase of setting area and maintenance cost, prolongation of working time, complication of working steps, etc., and thus there occurs the problem also that high cost is required.

On the other hand, various processes for hot dip-coating according to a one-stage coating method using a flux have been investigated. For example, as disclosed in JP-A-58-136759 and JP-A-4-202751, the fluxes are used to obtain a coating layer with Zn alloy containing 1 to 20% of aluminum, but they cannot be applied to hot dip-coating with aluminum alloy such as Al—Zn alloy containing 30% or above of aluminum or Al—Si alloy containing aluminum as a main component.

Further, U.S. Pat. No. 3,860,438, JP-A-3-162557 and JP-A-4-323356 disclose processes for coating with molten Al—Zn alloy containing 30 to 80% of Al according to a dry flux method. Among them, U.S. Pat. No. 3,860,438 discloses an aqueous flux containing as a main component a fluoride being composed of potassium flurosilicate, potassium fluoride, hydrofluoric acid and optionally zinc chloride, and JP-A-3-162557 suggests a process for hot-dip coating a steel material with Al—Zn alloy which comprises coating a zinc chloride-ammonium chloride aqueous solution type of flux specified in the mixing ratio of zinc chloride to ammonium chloride of 10/1 to 30/1 or an aqueous solution of flux mixed with at least one member selected from the group consisting of lithium chloride, potassium chloride and sodium flurosilicate with said flux on a steel material and then heat drying. However, in the above-mentioned processes, coating defects such as a non-coated portion easily occur and adhesion of oxide sometimes occurs since the effect to melt and decompose oxide, particularly aluminum oxide and the effect to oxidation-inhibit and activate a steel material surface in coating are not sufficiently obtained. Thus, the above-mentioned processes have the problem that a satisfactory result is not always obtained.

In JP-A-4-323356, there have been developed a molten flux being composed of alkali metal fluoride containing aluminum and alkaline earth metal chloride or further additionally alkali metal chloride and a process for hot dip-coating which comprises floating said flux on a molten Al—Zn alloy coating bath to conduct hot dip-coating. However, the process also has the problem that there often occur a non-coating portion and adhesion of oxide for a material having a complicated shape such as line bolt, nut and hardware having a combination part of pore shape or a steel material being composed of a steel constituent containing alloy element such as Si, Cr, V, etc., having large affinity with oxygen.

Regarding hot dip-coating with aluminum, hitherto, there has been known the process according to a one-stage coating method using a flux which comprises floating a flux containing 10% by weight (hereinafter, wt. %) or below of fluoride (alkali fluoride, cryolite, etc.,) and chloride (KCl, LiCl, NaCl, $CaCl_2$, $ZnCl_2$) etc., as main components on a molten Al coating bath to conduct hot dip-coating. However, the flux has drawbacks that deterioration of the flux during use remarkably occurs and its supplement is always required and furthermore a non-coating portion occurs depending on the shape of a steel material and the constituent of a steel.

Moreover, from the viewpoint of corrosion resistance for a long term, it is very effective to form a hot dip-coating layer with a molten aluminum alloy such as Al—Zn—Si alloy containing 20 to 65 wt. % of zinc and 0.5 to 3.5 wt. % of silicon to aluminum as main components or Al—Si alloy containing 3 to 12% of silicon main as a component, thick i.e., in a heavy coated weight on a steel material. The development for a process for coating thereof has been fervently desired:

Under such situation, regarding the above-mentioned processes for coating with a molten aluminum alloy, various processes for coating according to a one-stage coating method having industrial merit in both productivity and facility have been investigated. The one-stage coating method comprises coating directly a steel material with a molten aluminum alloy without using a two-stages coating method for conducting coating in separated two stages and without providing a coating undercoating layer for a steel material. For example, for a steel strip in which a continuous coating method can be easily applied, industrialized arts which comprise cleaning and activating a surface of a steel sheet with a reducing gas and sealing a coating bath to conduct hot-dip coating, i.e., so-called Sendimir method and NOF method have been established and put into practice. However, regarding the Al—Zn—Si and Al—Si alloy products hot dip-coated according to the coating process, the coating weight being adhered is at most about 100 g/m$^2$ per one side of a steel sheet, but under the present situation it is difficult to provide a heavy coating weight of hot dip-coating layer in order to make the hot dip-coating layer thicker.

Thus, regarding processes for coating with a molten aluminum alloy, particularly a molten Al—Zn—Si alloy or a molten Al—Si alloy according to a one-stage coating method using a flux which have been ever investigated, processes for coating able to form a hot dip-coating layer having no coating defects such as non-coating portion, and oxide have been investigated, but under the present situation, the process able to form a heavy coating weight of hot dip-coating layer has been hardly developed and investigated.

For example, a coating weight being adhered in a molten alloy-coated product for a steel strip in which a continuous coating method is applied according to a gas reducing method (Sendimir, NOF, etc.) is mainly about 85 g/m$^2$ per unit area for a molten Al—Zn—Si alloy-coated product and about 100 g/m$^2$ per unit area for a molten Al—Si alloy-coated product, as shown in various literatures and catalogues of product, e.g., "Galvalume Steel Sheet" by Nippon Steel Co., Ltd., published on June, 1990 and "Al sheet" in product catalogue published on October, 1993. It is considered that the above-mentioned amount is an upper limit of a coating weight being adhered. That is, also in a high speed coating method in which a coating weight being adhered becomes heavy due to the increase of amount of a molten coating metal being brought out in lifting up a coated material from the coating bath in case of conventional hot dip-coating, e.g., galvanizing. However, under the present situation, it is difficult to form a heavy coating weight or hot dip-coating layer in case of coating with a molten Al—Zn—Si alloy or a molten Al—Si alloy.

On the other hand, since it is difficult to conduct a continuous coating according to a gas reducing method due to shape, size of material, etc., a hot dip-coating according to a flux method is applied. For building construction, line hardware, bolt products, etc. in which corrosion resistance for a long term is required, it is particularly required to form a heavy coating weight of hot dip-coated uniform and smooth layer according to industrially excellent one-stage coating method. However, under the present situation, a coating process able to adhere in a heavy coating weight is not sufficiently established since there is the problem that it is difficult to conduct a high speed coating as in a continuous coating method for the above-mentioned steel strip and the increase of amount of a molten coating metal being brought out in lifting up a coated material from the coating bath is hardly expected.

SUMMARY OF THE INVENTION

The object of the present invention, under the above-mentioned circumstance, is to provide a process for hot dip-coating a steel material being composed of various steel constituents with a molten aluminum alloy including a molten Al—Si alloy and a molten Al—Zn—Si alloy which makes it possible to form a coating layer having no coating defects such as a non-coating portion and adhesion of oxide and presenting uniform and smooth appearance and providing excellent coating performances and furthermore to adhere a heavy coating weight of aluminum alloy in coating and a bath of molten coating alloy metal used in the process.

According to the first aspect of the present invention, there were conducted development for a chloride aqueous solution type of a flux expecting advantageous effects for a steel material to be coated, i.e., dry flux and various investigations for fluoride molten flux providing excellent advantageous effects for a molten aluminum alloy coating metal, and the problems in the prior processes were solved by applying the synergistic effect between both the above-mentioned fluxes, whereby an excellent process for coating with a molten aluminum alloy according to a flux method which makes one-stage coating possible was developed. Thus, the present invention, regarding molten aluminum alloy coating wherein a coating temperature of 580° C. to 700° C. is applied, e.g., coating with Al—Zn—Si alloy containing 20 to 65 wt. % of zinc and 0.5 to 3.5 wt. % of silicon to aluminum as main contents or coating with Al—si alloy containing 3 to 12 wt. % of silicon to aluminum as main content, provides a process for coating a steel material having various shapes and various steel constituents according to a one-stage coating method using a flux in which a hot dip-coated layer presenting uniform and smooth appearance and having no coating defects such as a non-coating portion and providing excellent coating performances can be formed.

That is, according to the first aspect of the present invention, there is provided a process for hot dip-coating a steel material with a molten aluminum alloy according to a one-stage coating method using a flux which comprises:

removing an oxide layer on a steel material surface, conducting activating treatment for the steel material surface, and conducting the following treatments on the steel material surface;

(i) treatment for coating with a chloride flux solution comprising main components being composed of (a) at least one chloride selected from the group consisting of calcium chloride and magnesium chloride and (b) at least one chloride selected from the group consisting of potassium chloride, lithium chloride and sodium chloride and then drying treatment, thereby forming a coating film of a dried chloride flux of 1.5 g/m$^2$ to 30 g/m$^2$ per surface area of the steel material as a coating weight and (ii) then, dipping the thus treated steel material in a molten aluminum alloy coating bath containing a floating fluoride-containing flux comprising main components being composed of (c) a fluoride containing aluminum, (d) at least one chloride selected from the group consisting of calcium chloride and magnesium chloride and (e) at least one chloride selected from the group consisting of potassium chloride, lithium chloride and sodium chloride, thereby coating the steel material surface with aluminum alloy.

According to the second aspect of the present invention, there was developed a process for hot dip-coating a steel material with a molten Al—Zn—Si alloy or a molten Al—si alloy according to a one-stage coating method using a flux which comprises adjusting surface roughness of the steel material and increasing viscosity of a molten coating metal alloy, thereby increasing a molten coating metal amount adhered to the steel material to be brought out from a coating bath and preventing the molten coating metal naturally flowing out to conduct treatment for control of a coating weight being adhered in the state wherein a large amount of a molten coating metal is adhered on a surface of the steel material and in some case conducting smoothing treatment. Thus, the problems in the prior processes were solved. That is, a process for hot dip-coating which makes it possible to form a heavy coating weight of a hot dip-coated uniform and smooth layer and a bath of molten coating metal used in the process was developed.

In molten Al—Zn—Si alloy product and a molten Al—si alloy-coated product for building construction, bolt products, etc., requiring corrosion resistance for a long term, there is required a coating-weight corresponding to 350 g/m$^2$ or above per unit area as a heavy coating weight standard, i.e., about coating thickness 50 $\mu$m(calculated as specific gravity 7.14) which is applied to a hot dip-galvanized product. According to the present invention, there can be formed a hot dip-coated layer having a coating weight of 190 g/m$^2$ or above (calculated as specific gravity about 3.80), particularly 200 g/m$^2$ or above in a molten Al—Zn—Si alloy-coated product or a coating weight of 132 g/m$^2$ or above (calculated as about 2.64), particularly 150 g/m$^2$ or above in a molten Al—Si alloy-coated product.

That is, according to the second aspect of the present invention, there is provided a process for hot dip-coating a steel material with a molten aluminum alloy by one-stage coating method using a flux which comprises:

removing an oxide layer on a steel material surface, adjusting average roughness of the steel material surface to the range of 2.5 to 7.5 $\mu$mRa, conducting activating treatment for the steel material surface, dipping the steel material in a molten Al—Zn—Si alloy coating bath or a molten Al—si alloy coating bath containing a floating a flux wherein an iron component of 0.25 to 1.5 out % by weight to the total weight of the molten alloy metal except the flux has been added to the bath of molten metal, and then, conducting treatment for control of coating weight being adhered, thereby coating the steel material surface with the molten Al—Zn—Si alloy or the molten Al—Si alloy to adhere a heavy coating weight thereof to the steel material surface, and an aluminum alloy coating bath using a flux which comprises a molten Al—Zn—Si alloy or a molten Al—Si alloy and a molten iron component of 0.25 to 1.5% by weight to the total weight of the molten alloy metal bath except the flux.

DETAILED DESCRIPTION OF THE INVENTION

Firstly, the first aspect the present invention will be described in detail below.

An oxide layer adhered on a surface of a steel material is removed by pickling with an acid such as an aqueous hydrochloric acid or sulfuric acid solution and then rinsing with water (hereinafter, water rinsing) and an activating treatment are conducted. Or an oxide layer is removed by mechanical means such as shot blast, grit blast, etc., and then brief acid pickling treatment is conducted and water rinsing treatment, or only water rinsing and activating treatment are conducted. Then, a chloride flux comprising main components being composed of (a) at least one chloride selected from the group consisting of calcium chloride and magnesium chloride and (b) at least one chloride selected from the group consisting of potassium chloride, lithium chloride and sodium chloride are coated on the thus treated surface of the steel material and drying treatment is conducted, whereby a coating film of a chloride flux is formed.

The aqueous flux consisting of chloride which is applied as a dry flux to a steel material is used for the following objects.

1̂ The flux inhibits oxidation for a steel material surface in the course until the steel material surface, in which an oxide layer has been removed and in which has been subjected to an activating treatment, is dipped in a molten aluminum alloy coating bath.

2̂ The flux promotes further cleaning and activating for a steel material surface with a molten salt being molten and produced in the course until the steel material surface is dipped into a molten coating bath.

3̂ The flux stably floats with a molten flux being used in the present invention on coating bath without being vaporized and dissipated and oxidation for the coating bath is inhibited and advantageous effects of the molten flux for the coating bath are further promoted.

Accordingly, the chloride aqueous solution type of a dry flux is a more chemically stable chloride than aluminum chloride, because that is generally vaporized and dissipated at coating temperature of from 580° to 700° C. and comprises main components being composed of (a) at least one chloride selected from the group consisting of calcium chloride and magnesium chloride having an oxidation-inhibiting effect for a steel material surface and (b) at least one chloride selected from the group consisting of potassium chloride, lithium chloride and sodium chloride.

It is preferred that the aqueous flux consisting of chloride being used as a dry flux contains (a) in the range of 5 to 70 wt. %, preferably 15 to 50 wt %. It is necessary to form a coating layer in the range of 1.5 g/m$^2$ to 30 g/m$^2$ per surface area of a material by coating the aqueous flux consisting of chloride on a steel material surface and conducting drying treatment.

That is, when content of (a) being contained in the chloride aqueous solution of a flux is below 5 wt. %, oxidation-inhibition effect for a steel material cannot be often obtained and non-coating portion is readily caused and furthermore formation of a coating layer presenting uniform and smooth coated appearance and providing excellent coating performances is readily hindered, whereas above 70 wt. %, oxidation-inhibiting effect for a steel material by the flux is saturated and moisture is easily absorbed in the flux after drying treatment since calcium chloride and magnesium chloride have hygroscopic property to increase occurrence of splash of the coating molten metal when the steel material surface is dipped in the coating molten metal and to cause non-coating portion and deterioration of uniformity of coated appearance.

The other components are not particularly limited and may be composed so as to be melted at the above-mentioned coating process.

In the molten aluminum alloy coating being applied in the present invention, considering from the melting temperature in the aluminum alloy coating bath, a coating temperature of 580° to 700° C., preferably 610° to 680° C. is applied.

The solvent for the present chloride flux is not limited, preferably water. A solvent having a high drying speed, e.g. alcohol also may be properly selected.

The coating method and coating conditions are not particularly limited. For example, coating treatment according to a dipping method or a spraying method is conducted at a temperature of room temperature to 90° C. Then, after the coating treatment, drying treatment is conducted to remove moisture contained in the coating of the flux. The method and conditions of the drying treatment are not particularly limited. For example, a hot wind drying method, a gas or electrical heating method, an infrared ray heating method, etc., are applied. Heat drying treatment for a short time at surface temperature of 60° to 250° C., preferably 80° to 200° C. is applied. When a large amount of moisture remains in the flux coating on the steel material, the flux coating slips off from the steel material in the course until the coated steel material is dipped in the coating bath and the intended advantageous effects in the present invention cannot be obtained, and furthermore danger of steam explosion in dipping into the coating bath and splash of the molten coating metal readily occur to cause non-coating portion and deterioration of uniformity of coated appearance. Therefore, in the present invention, it is necessary to remove moisture in the flux coating on the steel material by drying treatment.

The adhered amount of the chloride flux formed as a coating layer is limited to 1.5 to 30 g/m$^2$ per surface area of steel material.

When the adhered amount is below 1.5 g/m$^2$, the coating film of the chloride flux being formed on the steel material has many defects and oxidation-inhibiting effect of the flux for the steel material is not sufficient in the course until the coated steel material is dipped in the coating bath and effects promoting cleaning and activation for a surface of the steel material are not always provided since a supplying amount of the chloride flux being molten on the coating bath is small, so that coating defects such as non-coating portion are caused, whereas above 30 g/m$^2$, the above-mentioned oxidation-inhibiting effect is saturated and melting of the chloride flux and its slipping-off from the steel surface material are not sufficiently conducted since the adhered amount of the chloride flux is too large in the course until the coated material is dipped in the coating bath, so that coating defects such as non-coating portion are caused.

The concentration of the chloride flux solution is particularly not limited, and may be optionally selected from solubility of chloride in the chloride flux, a shape and surface roughness of a steel material and capacity of drying treatment step, etc. Generally, it is preferred to use a chloride aqueous solution of a flux having a concentration of 50 g/l to 250 g/l.

Even if only the above-mentioned dry flux is used to conduct coating with molten aluminum alloy, it is insufficient to form the intended coating film in the present invention having non-coating defects such as non-coating a portion and presenting uniform and smooth coated appearance. That is, when the chloride dry flux is adhered and formed on a steel material as a coating film as described above and floated as a molten flux on an aluminum alloy coating bath to conduct coating with a molten aluminum alloy, coating defects due to adhesion of oxides being produced in the coating bath to the steel material occur since both abilities of decomposition and melting for the oxides are insufficient or uniformity of coating appearance deteriorates.

Therefore, in order to attain the object in the present invention, it is necessary to conduct further hot dip-coating by dipping the steel material subjected to the above-mentioned treatment with the dry flux in a molten aluminum alloy coating bath having a floated molten flux comprising main components being composed of (c) a fluoride containing aluminum, (d) at least one chloride selected from the group consisting of calcium chloride and magnesium chloride and (e) at least one chloride selected from the group consisting of potassium chloride, lithium chloride and sodium chloride.

The above-mentioned molten flux is used for the following objects.

1̂ The flux is molten and stably floats on a coating bath to decompose oxides being produced in the coating bath, particularly aluminum oxide, whereby cleaning of the coating bath is conducted.

2̂ The flux is molten and floats with the chloride dry flux being brought with a steel material in the coating step to inhibit oxidation for a coating bath and furthermore promote cleaning and activating of the steel material surface.

Thus, the molten flux comprises main components being composed of (c) component which is excellent in the effects of decomposition of aluminum oxides and (d) and (e) components which lower the melting temperature of fluoride and stably float and are molten on a coating bath at a hot dip-coating temperature to provide effectively the above-mentioned effects and are chemically more stable than aluminum chloride.

As a preferable embodiment, which is not particularly limited in the present invention, when chloride in a chloride aqueous solution flux being used as a dry flux is the same as that in the above-mentioned molten flux, it is advantageous in the continuation of the advantageous effects of the molten flux and in operation and maintenance of the coating bath since chloride being brought with a steel material is used as a chloride being supplemented for the molten flux.

In the present invention, examples of (c) fluoride containing aluminum include at least one member selected from the group consisting of cryolite ($Na_3AlF_6$) and aluminum fluoride. An example of chloride includes a molten flux being composed of a mixture of (d) calcium chloride and magnesium chloride and (e) potassium chloride, lithium chloride and sodium chloride.

When the content (c)/{the content (c)+the content (d)+the content (e)} (hereinafter, referred to content (c)) is below 15 wt. %, the effect for decomposing oxides being produced in a molten aluminum coating bath is insufficient and coating defects such as a non-coating portion, etc., occur and uniformity of coated appearance deteriorates due to adhesion of oxides on a coating surface, whereas above 60 wt. %, the effect is saturated and even if the proportion of content of fluoride to chloride is changed at a molten aluminum alloy coating temperature, it is difficult to maintain a sufficiently melted state.

Thus, in order to attain the object of the present invention, it is preferred that the content (c) in the molten flux is limited to the range of 15 to 60 wt. %. More preferably, the content (c) is 25 wt. % or above from the viewpoint of keeping continuation of the effect of the molten flux, particularly the effects for bringing the chloride flux with the steel material and supplementing chloride and 50 wt. % or below from the viewpoint of the range of chloride content being selected for maintaining a melting and floating state of the flux on the molten coating bath.

The thickness of the melting flux being floated on the bath of molten coating aluminum alloy metal is not particularly limited, preferably 10 to 100 mm, more preferably 15 to 60 mm. When the thickness is below 10 mm, the effect for oxidation-inhibiting the coating bath is not sufficiently provided, whereas above 100 mm, the effect for oxidation-inhibiting the coating bath and the effect for decomposing oxides in the coating bath are saturated and the amount of the molten flux being adhered to the coated product and brought increases to provide economical disadvantage and furthermore it is unpreferable since there is caused a problem that a large amount of the molten flux is adhered to the coated product, so that it becomes difficult to remove it. Therefore, it is preferred to supplement properly the molten flux so as to maintain the above-mentioned thickness on the coating bath.

The present process is summarized as follows.

That is, a chloride flux solution comprising main components being composed of the (a) chloride and the (b) chloride is coated on a steel material surface being coated to conduct drying treatment, and thereby a dry flux coating film is formed, and then thus treated steel material is dipped in a molten aluminum alloy coating bath having a floating molten flux to conduct coating.

In the industrial production, generally, a steel material is dipped in a molten aluminum alloy coating bath depending on a size of the steel material, a treating amount and intended coating weight being adhered, at a coating temperature based on composition of the bath for 30 sec to 10 min and thus coated steel material is lifted up from the coating bath and then the coating weight being adhered is adjusted to form a coating layer.

As described above, in the present process, the following effects are provided by the function of the aqueous solution flux consisting of chloride being formed as a coating film on a steel material being coated.

1̂ Removal of an oxide layer on a steel material and oxidation-inhibition for the steel material surface in the course until the steel material is subjected to activating treatment and then dipped in a molten coating bath.

2̂ Cleaning and activation of a steel material surface and oxidation-inhibition for coated surface in the course until the steel material is dipped in a molten coating bath, particularly promotion of the foregoing effects due to melting in the state of with a molten flux.

Additionally, the following further effects are provided by both function of (c) a fluoride containing aluminum and a molten flux being composed of the above-mentioned chlorides.

3̂ Cleaning of a coating bath by decomposition and melting of oxides being produced in the coating bath, particularly aluminum oxides.

4̂ Oxidation-inhibition for a coating bath and promotion of cleaning and activation of a steel material surface due to melting in the state of coexistence with a chloride flux being brought in coating.

Thus, by the synergistic effect between the chloride dry flux and the molten flux, a hot dip-coated layer being composed of a molten aluminum alloy having no coating defects such as non-coating portion and presenting uniform and smooth appearance and providing excellent coating performances is easily formed.

Regarding the both fluxes being used in the present process, as the chloride in a chloride aqueous solution type of chloride, there is used more stable chloride than aluminum chloride and zinc chloride being produced by the reaction between main metallic components being contained in a molten aluminum alloy coating bath and chloride. It is preferred that the molten flux is composed of large amount of (c) a fluoride containing aluminum and the same species of chloride as in the chloride dry flux, preferably a chloride having the same component as in the chloride dry flux, whereby chloride is supplemented for the molten flux floating on a coating bath by the chloride dry flux being brought with a steel material and there can be obtained the advantage that both stability and continuation of the effects of the molten flux are excellent since a large amount of fluoride is contained.

As the molten aluminum alloy coating bath being applied in the present process, there is used a alloy coating bath comprising aluminum as a main component wherein a coating temperature of 580° to 700° C. is applied. Examples of the molten aluminum alloy coating bath include an Al-(20 to 65%) Zn-(0.5 to 3.5%) Si alloy bath comprising aluminum and zinc as main components, an Al-(3 to 12%) Si alloy coating bath, an alloy coating bath further added a small amount of Mg, Cr, Cu, Ti, Mn, Sn, Fe, etc., to the above-mentioned coating bath, an alloy coating bath containing impurities being inevitably mixed from a coating apparatus, a molten metal, a steel material, etc., in the above-mentioned coating bath, etc.

Next, the second aspect of the present invention will be described in detail below.

Firstly, the present process for hot dip-coating a steel material with a molten Al—Zn—Si alloy or a molten Al—si alloy to adhere a heavy coating weight thereof is described.

The coating being applied in the present invention includes a molten Al—Zn—Si alloy coating wherein a coating temperature of 580° to 700° C., preferably 610° to 680° C. is generally applied, e.g., a molten Al—Zn—Si alloy coating comprising main contents being composed of 20 to 65 wt. % of Zn and 0.5 to 3.5 wt. % of silicon to aluminum, and a molten Al—si alloy coating comprising a main content being composed of 3 to 12 wt. % of silicon to aluminum, etc.

The object in the present invention is to form a hot dip-coated layer of about coating thickness 50 $\mu$m or above having no coating defects such as non-coating portion and presenting uniform and smooth coated appearance, in a heavy coating weight, i.e., a coating weight of 190 g/m$^2$ or above (calculated as specific gravity about 3.80) per unit area in a molten Al—Zn—Si alloy coated product, particularly 200 g/m$^2$ or above, a coating weight of 132 g/m$^2$ or above (calculated as specific gravity about 2.64) in a molten Al—Si alloy coated product, particularly 150 g/m$^2$ or above, according to a one-stage coating method using a flux.

The species of steel material being coated is not limited.

A steel material being coated is firstly subjected to treatment for removal of an oxide layer and adjusting treatment for surface roughness. The method is not particularly limited. There is applied a method which comprises removing an oxide layer by pickling with an acid such as an aqueous hydrochloric acid or sulfuric acid solution, and etc., and then adjusting surface roughness by mechanical means such as shot blast, grit blast, etc., or a method which comprises conducting at the same time both removal of an oxide layer and adjustment of surface roughness by mechanical means such as shot blast, grit blast, etc.

In conventional molten alloy coating for a steel material, there is a problem that it is difficult to ensure sufficiently an amount of a molten coating alloy metal being brought due to anchor effect in lifting up a steel material from the coating bath since formation and growth of an alloy layer are suppressed due to the effect of silicon in the bath of molten coating alloy metal. Therefore, in the present invention, adjustment of surface roughness of steel material is conducted in order to solve such problem. That is, the amount of a molten coating alloy metal adhered to a steel material and brought out is increased due to anchor effect by adjusting appropriately surface roughness of the steel material to rough minutely the surface.

The surface roughness of a steel material is preferably in the range of average roughness 2.5 $\mu$mRa to 7.5 $\mu$mRa, more preferably in range of average roughness 3.0 $\mu$mRa to 5.5 $\mu$mRa. When the surface roughness of a steel material is below average roughness 2.5 μmRa, it is difficult to ensure sufficiently an amount of a molten coating alloy metal being brought out due to anchor effect in lifting up the steel material from the coating bath, whereas above average roughness 7.5 μmRa it is unpreferable since there occurs a problem that an amount of a molten coating alloy metal being brought out is saturated and smoothness of hot dip-coated layer surface after treatment for control of coating weight being adhered deteriorates, etc.

A steel material is subjected to adjusting treatment for surface roughness and then subjected to activating treatment used a hydrochloric acid aqueous solution, etc., and washing treatment and then a molten Al—Zn—Si alloy coating or a molten Al—si alloy coating according to a one-stage coating method using a flux is conducted.

In the second aspect of the present invention, a flux being used and conditions for using the flux are not particularly limited. For example, a hot-dip coating is conducted by using both a dry flux containing 5 to 70 wt. % of at least one chloride selected from the group consisting of calcium chloride and magnesium chloride, e.g., a flux being composed of a chloride aqueous solution comprising main components of at least one chloride selected from the group consisting of calcium chloride and magnesium chloride and at least one chloride selected from the group consisting of potassium chloride, lithium chloride and sodium chloride, and a molten flux containing 15 to 60 wt. % of fluoride containing aluminum, e.g., a flux comprising main components of at least one fluoride containing aluminum, at least one chloride selected from the group consisting of calcium chloride and magnesium chloride and at least one chloride selected from the group consisting of potassium chloride, lithium chloride and sodium chloride.

In the present invention, a steel material, wherein an oxide layer is removed, adjusted surface roughness is adjusted and subjected to activating treatment, is subjected to coating treatment with the above-mentioned chloride dry flux and heat drying treatment to form a coating film of 1.5 $g/m^2$ to 30 $g/m^2$ per surface area and then dipped in a molten a molten Al—Zn—Si alloy coating bath or a molten Al—Si alloy coating bath floated the above-mentioned molten flux containing fluoride and increased viscosity, and maintained in the state for specified time and then lifted up from the coating bath and subjected to treatment for control of a coating weight being adhered or smoothing treatment after the treatment for control, whereby a hot dip-coated layer is formed.

In order to attain the object of the present invention, as described above, it is necessary to increase viscosity of a molten Al—Zn—Sn alloy coating bath or a molten Al—Si alloy coating bath in addition to adjustment of surface roughness of a steel material. That is, it is important to conduct treatment for control of coating weight being adhered in the state adhered a large amount of a molten coating metal on a steel material surface after lifting up the steel material from the coating bath. Therefore, viscosity of the coating bath is increased for attaining increase of an amount of the molten coating alloy metal being brought, and natural flowing of the molten coating alloy metal is prevented to maintain it on the steel material surface.

Therefore, as a result of various investigations to attain the object of the invention, it is very effective to melt an appropriate amount of an iron component and add it to a molten Al—Zn—Si alloy coating bath or a molten Al—Si alloy coating bath.

The iron component being molten and added is not particularly limited. Examples of the iron component include a high purity of an electrolytic iron, a steel sheet and steel material containing a small amount of C, Mn, Si, P, S, Al, Cr, etc., as inevitable impurities, etc.

The content of the iron component being added is limited to the range of 0.25 to 1.5 wt. % to the total weight of a molten alloy metal except a flux, preferably in the range of 0.35 to 1.2 wt. %.

When the content of the iron component is below 0.25 wt. %, the effect for increasing viscosity of the molten alloy coating bath is small and even if surface roughness of a steel material is adjusted as described above, it is difficult to adhere and maintain a large amount of a molten coating alloy metal to the steel material surface after lifting up from the molten coating bath by increasing an amount of the molten alloy coating bath being brought and preventing natural flowing thereof, so that it is hindered to form intended heavy coating weight of hot dip-coated uniform and smooth layer.

On the other hand, when the content of the iron component is above 1.5 wt. %, it is unpreferable since a non-molten reaction product between the iron component and components constituting the alloy coating bath and oxide thereof, i.e., the so-called "dross" increases too much and adheres on the hot dip-coated layer in the region of a molten Al—Zn—Si alloy or molten Al—Si alloy coating temperature, so that uniformity of coated appearance and performances deteriorate.

The method for melting an iron component and adding to a molten alloy coating bath is not particularly limited. Examples of the method include a method for melting and adding aluminum or zinc containing an iron component as a mother alloy at the time of producing a molten Al—Zn—Si alloy coating bath or a molten Al—Si alloy coating bath or a method for melting and adding an electrolytic iron, a steel material, etc., in the above-mentioned molten alloy coating bath.

It is necessary to adjust and control an amount of the iron component in a molten alloy coating bath including a content of the iron component being molten and added and that being inevitably contained by dissolution from a coating apparatus, a steel material, etc.

As described above, it is prevented to form an alloy layer due to the reaction between a molten alloy and a steel material. Further, in a molten Al—Zn—Si alloy coating or a molten Al—Si alloy coating in which it is difficult to increase an amount of a molten coating alloy metal adhered to a steel material and being brought in lifting up the steel material from the coating bath since the molten coating alloy metal has remarkable fluidity, it becomes possible to conduct treatment for control of coating weight being adhered in the state adhered a large amount of a molten coating metal on a steel material surface after lifting up the steel material from the coating bath, by adjusting surface roughness of the steel material and adding an iron component to increase viscosity of the molten alloy bath. That is, since in such state it is possible to wipe off excess molten coating metal adhered to a steel material by a specified coating weight by a high pressure gas method, a high pressure steam method, a rotating separation method using a centrifugal separator, etc., a molten Al—Zn—Si alloy or molten Al—Si alloy hot dip-coated uniform and smooth layer can be formed in a large adhered a mount.

Particularly, in the present invention, regarding a method of treatment for control of a coating weight being adhered, a rotating separation method using a centrifugal separator, i.e., a method for control of a coating weight being adhered which comprises adjusting a circumferential speed of a steel material adhered a molten coating metal to be coated with a centrifugal separator is more effective in forming a hot dip-coated, more uniform and smoother layer than other control methods. That is, in a method for control of a coating weight being adhered which comprises blowing directly a steel material adhered a molten coating metal with a high pressure gas, high pressure steam, etc., to wipe off excess molten coating metal, a stagnate portion of wiped excess molten coating metal is easily generated in a lower end portion of the steel material since measures for increase of viscosity of a molten coating metal have been taken in the present invention and furthermore when dross, etc., contained in the molten coating metal remains without being sufficiently removed, it is sometimes observed that a partial stagnate portion of the molten coating metal is generated. Therefore, there is a disadvantage that in some cases it is required to remove the above-mentioned stagnate portion of a molten coating metal by mechanical means, etc., after treatment for control of a coating weight being adhered.

Therefore, the method for control of a coating weight being adhered which comprises adjusting a circumferential speed of a steel material adhered a molten coating metal with a centrifugal separator is particularly effective in attaining the object of the present invention since it is possible to wipe off excess adhered molten coating metal and dross, etc., from the surface for the exterior by rotation and none of the above-mentioned problems occur.

In the present invention, in order to obtain an uniform and smooth layer hot dip-coated with a molten Al—Zn—Si alloy or molten Al—Si alloy in a large adhered amount, a steel material adhered a molten alloy coating bath is subjected to treatment for control of a coating weight being adhered by adjusting a circumferential speed to the range of 400 to 1,500 m/min, preferably 450 to 1,150 min/min, with a centrifugal separator. When the circumferential speed is below 400 m/min, it is difficult to wipe off excess molten coating metal adhered to a steel material by a rotating separation method before the molten coating metal is solidified, so that uniformity and smoothness of a hot dip-coated layer being formed on the steel material surface are not always excellent, whereas above 1,500 m/min, it is easy to wipe off excess coating metal and uniformity and smoothness of a hot dip-coated layer are excellent, but it is unpreferable since an adhered amount of a molten coating metal is too small.

The treating time is not particularly limited. That is, the treating time may be optionally selected from an amount of a molten coating metal being brought out with a steel material, a temperature of the coating metal, treating quantity, treating size, etc. In the present invention, generally, based on a circumferential speed designated by considering intended coating weight being adhered, the above-mentioned other factors, etc., it is preferable to control a coating weight being adhered by wiping-off excess molten coating metal adhered to a steel material at a treating time of the range of 3 to 30 sec, preferably 5 to 25 sec and then cool and thereby form a coating layer.

Further, in the present invention, the below process is applied in order to form a hot dip-coated uniform and smooth layer in a screw part of a material being coated having screw part including bolt, nut, etc., and below likewise, to form a heavy coating weight of a hot dip-coated uniform and smooth layer in parts other than the screw part, i.e., head portion, middle portion in the bolt and exterior portion, upper surface portion and low surface portion in the nut.

A molten coating metal adhered to a steel material is subjected to wiping treatment comprising rotating in a specified direction at a designated circumferential speed for a treating time corresponding to intended coating weight being adhered with a centrifugal separator to control the coating weight being adhered and then subjected to rotating treatment in a reverse direction to said direction at a lower circumferential speed for a shorter time than the above-mentioned wiping treatment. That is, a molten coating metal adhered to a steel material is subjected to wiping treatment for intended coating weight being adhered by being rotated in a specified direction and further to rotating treatment in a reverse direction under the conditions wherein the molten coating metal is neither wiped off nor removed toward the exterior before the molten coating metal is solidified, whereby smoothing due to migration of the molten coating metal on the steel material surface toward a reverse direction is remarkably promoted and particularly in a screw part including bolt, nut etc.

In order to attain the object according the present process, rotating treatment in a reverse direction is conducted at circumferential speed $V_1$ m/min =⅓ $V_0$ to ⅘ $V_0$ m/min, preferably ⅔ $V_0$ to ¾ $V_0$ m/min to circumferential speed $V_0$ m/min in wiping treatment for a molten coating metal, for treating time $t_1$ sec=⅕ $t_0$ to ¾ $t_0$ sec, preferably ⅔ $t_0$ to ⅗ $t_0$ sec to treating time $t_0$ sec in wiping treatment. When the circumferential speed $V_1$ m/min in rotating treatment is below ⅓ $V_0$ m/min, it is difficult to conduct sufficiently smoothing treatment due to migration of a molten coating metal toward a reverse direction, whereas above ⅘ $V_0$ m/min it is unpreferable since wiping treatment for the molten coating metal further proceeds, whereby a coating weight being adhered decreases.

When the treating time is below ⅕ $t_0$ sec, it is difficult to conduct sufficiently smoothing treatment since treating time for migration of a molten coating metal toward a reverse direction is too short, whereas above ¾ $t_0$ sec it is unpreferable since smoothing effect is saturated and a coating weight being adhered decreases due to wiping treatment for the molten coating metal depending on circumferential speed being applied.

Smoothing effect due to migration of a molten coating metal on a steel material surface toward a reverse direction is remarkably provided, particularly in the material having a screw part including bolt, nut, etc., to be coated. The present process can be applied also in a material having other shape to be coated.

As described above, formation of an alloy layer is suppressed due to function of silicon being contained in a bath of molten coating alloy metal. Further, since fluidity of a molten coating alloy metal is very large, in a molten Al—Zn—Si alloy coating and a molten Al—Si alloy coating wherein it is difficult to form a heavy coating weight of hot dip-coated layer, the present invention can provide a very excellent process for hot-dip coating a steel material according a one-stage coating method using a flux which makes it possible to form a heavy coating weight of hot dip-coated uniform and smooth layer.

Next, an aluminum alloy coating bath in the present invention is described below.

The present aluminum alloy coating bath comprises a molten Al—Zn—Si alloy or a molten Al—Si alloy and a molten iron component of 0.25 to 1.5 wt. % to the total weight of the molten alloy metal except the flux, wherein a coating temperature of from 580° to 700° C., preferably from 610° to 680° C. is applied. Examples of the present aluminum alloy coating bath include a Al-(20 to 65%)Zn-(0.5 to 3.5%)Si alloy coating bath comprising aluminum, zinc and silicon, a Al-(3 to 12%)Si alloy coating bath comprising aluminum and silicon, an alloy coating bath further added a small amount of Mg, Cr, Cu, Ti, Mn, Sn, etc. to the above-mentioned bath, etc.

PREFERRED EMBODIMENTS OF THE INVENTION

The components of sample steels A to D are shown in table 1.

EXAMPLE 1

A bolt (M 22, 75 mm) prepared using sample steel A was degreased and water rinsed. Then an oxide layer was removed by grit blast and surface roughness was adjusted. The thus treated bolt was subjected to pretreatment of both activating treatment with a 10 wt. % hydrochloric acid aqueous solution and water rinsing, followed by coating of a flux being composed of a (38 g/l calcium chloride-108 g/l potassium chloride-54 g/l sodium chloride) aqueous solution, i.e., a chloride flux solution containing 19 wt. % of calcium chloride in chlorides according to a dipping method and then heat drying treatment at 100° C. for 15 min, whereby a chloride dry flux coating film of an adhered amount 15.6 g/m$^2$ was formed on the bolt.

Then, the thus treated bolt was dipped in a molten Al-43.5% Zn-1.5% Si alloy coating bath of temperature 630° C. floated a molten flux being composed of components of cryolite (15 wt. %)-aluminum fluoride (30 wt. %)-calcium chloride (10.45 wt. %)-potassium chloride (29.7 wt. %)-sodium chloride (14.85 wt. %), i.e., a molten flux containing 45 wt. % of a fluoride containing aluminum and chlorides having about the same components as the above-mentioned chloride dry flux in thickness about 15 mm and maintained in the state for 2 min. Then, the bolt was lifted up from the coating bath and subjected to adjustment of a coating weight being adhered according to a centrifugal separation method cooled with water (hereinafter referred to "water cooled") and dried.

In the coating treatment, 15 pieces of the bolt having the above-mentioned size, put in a basket for coating were dipped in the coating bath and lifted up from the coating bath, and then immediately transferred to an apparatus for control of coating weight being adhered according to a centrifugal separation method to adjust a coating weight.

As a result, in all 15 pieces of the bolt, Al—Zn alloy coated bolts having no coating defects and presenting uniform and smooth appearance were obtained in a coating weight of 110 to 140 g/m$^2$ (average 125 g/m$^2$). Further, as a result of salt spray test (JIS-Z-2371) for the coated bolts, in the test of 1,000 hr, no red rust from steel substrate due to coating defects was generated and only white rust from the coating layer was generated and coating performances were remarkably excellent.

Comparative Example 1

The bolt prepared in the same manner as in Example 1 was degreased and water rinsed. Then, an oxide layer was removed by grit blast and surface roughness was adjusted. The thus treated bolt was subjected to pretreatment of both activating treatment with a 10 wt. % hydrochloric acid aqueous solution and water rinsing, followed by heat drying treatment at 100° C. for 10 min to remove moisture.

Then, the thus treated bolt was dipped in a molten Al-43.5% Zn-1.5% Si alloy coating bath and floated a molten flux of 630° C. having the same components as in Example 1, in thickness about 15 mm and maintained in the state for 2 min. Then, the bolt was lifted up from the coating bath and subjected to treatment for control of coating weight being adhered in the same manner as in Example 1, water cooled and dried.

As a result, rust was generated in the course until the bolt was dipped in the coating bath after pretreatment, and in only function of the molten flux, cleaning and activating for the bolt surface were not sufficient. In all 15 pieces of the bolt, coating defects occurred in several places and coated appearance was very poor. As a result of salt spray test, in the test of 120 hr, red rust from steel substrate was remarkably generated.

EXAMPLE 2

A bolt (M24, 120 mm) prepared using sample steel C was degreased and water rinsed. Then, an oxide layer was removed by grit blast and surface roughness was adjusted. The thus treated bolt was subjected to pretreatment of both activating treatment with a 10 wt. % hydrochloric acid aqueous solution and water rinsing, followed by coating of a flux being composed of a (30 g/l calcium chloride-10 g/l magnesium chloride-140 g/l potassium chloride-20 g/l sodium chloride) aqueous solution, i.e., a chloride flux solution containing 15 wt. % of calcium chloride and 5 wt. % of magnesium chloride in chlorides according to a dipping method and heat drying treatment at 150° C. for 10 min, whereby a chloride dry flux coating film of an adhered amount 20.8 g/m$^2$ was formed on the bolt.

Then, the thus treated bolt was dipped in a molten Al-41.7% Zn-0.5% Mg-2.8% Si alloy coating bath of temperature 660° C. floated a molten flux being composed of contents of cryolite (23 wt. %)-aluminum fluoride (27 wt. %)-calcium chloride (7.5 wt. %)-magnesium chloride (2.5 wt. %)-potassium chloride (35 wt. %)-sodium chloride (5 wt. %), i.e., a molten flux containing 50 wt. % of a fluoride containing aluminum and chlorides having about the same components as the above-mentioned chloride dry flux in thickness about 20 mm and maintained in the state for 1.5 min. Then, the bolt was lifted up from the coating bath and subjected to treatment for control of coating weight being adhered according to a centrifugal separation method, water cooled and dried.

In the coating treatment, 10 pieces of the bolt having the above-mentioned size, put in basket for coating were dipped in the coating bath and lifted up from the coating bath, and then immediately transferred to an apparatus for control of coating weight being adhered according to a centrifugal separation method to adjust a coating weight.

As a result, in all 10 pieces of the bolt, Al—Zn alloy coated bolts having no coating defects and presenting uniform and smooth appearance were obtained in a coating weight of 140 to 165 g/m$^2$ (average 151.3 g/m$^2$). Further, as a result of salt spray test (JIS-Z-2371) for the coated bolts, in the test of 1,000 hr, no red rust from steel substrate due to coating defects was generated and only white rust from the coating layer was generated and coating performances were remarkably excellent.

Comparative Example 2

The bolt prepared in the same manner as in Example 2 was degreased and water rinsed. Then, oxide layer was removed by grit blast and surface roughness was adjusted. Then, the thus treated bolt was subjected to pretreatment of both activating treatment with a 10 wt. % hydrochloric acid aqueous solution and water rinsing, followed by coating of a flux being composed of a (350 g/l potassium chloride-50 g/l sodium chloride) aqueous solution, i.e., a chloride flux solution containing no at least one chloride selected from the group consisting of calcium chloride and magnesium chloride according to a dipping method and then heat drying treatment at 150° C. for 10 min to remove moisture, whereby a chloride dry flux coating of an adhered amount 21.8 g/m$^2$ was formed on the bolt.

Then, the thus treated bolt was dipped in a molten Al-41.7% Zn-0.5%Mg-2.8% Si alloy coating bath of temperature 660° C. floated a molten flux having the same components as in Example 2 in thickness about 20 mm and maintained in the state for 1.5 min. Then, the bolt was subjected to treatment for control of coating weight being adhered in the same manner as in Example 2, water cooled and dried.

As a result, rust was generated in the course until the bolt was dipped in the coating bath after the pretreatment since no rust-inhibiting effect with a chloride dry flux was provided, and in only function of the molten flux, cleaning and activating for the bolt surface were not sufficient. In all 10 pieces of the bolt, coating defects occurred in several places and coated appearance was very poor. As a result of salt spray test, in the test of 120 hr, red rust from steel substrate was remarkably generated.

EXAMPLE 3

A washer (outer diameter 43 mm, inner diameter 25 mm, thickness 4.5 mm) prepared using sample steel B was degreased and water rinsed. Then, an oxide layer was removed by grit blast and surface roughness was adjusted. Then, the thus treated washer was subjected to pretreatment of both activating treatment with a 7.5 wt. % hydrochloric acid aqueous solution and water rinsing, followed by coating of a flux being composed of a (30 g/l calcium chloride-80 g/l potassium chloride-90 g/l sodium chloride) aqueous solution, i.e., a chloride flux solution containing 15 wt. % of calcium chloride in chlorides according to a spraying method and heat drying treatment at 150° C. for 10 min, whereby a chloride dry flux coating film of an adhered amount 7.8 g/m$^2$ per one side was formed on the washer.

Then, the thus treated washer was dipped in a molten Al-59.2% Zn-0.8% Si alloy coating bath of temperature 615° C. floated a molten flux being composed of contents of aluminum fluoride (25 wt. %)-calcium chloride (11.25 wt. %)-potassium chloride (30 wt. %)-sodium chloride (33.75 wt. %), i.e., a molten flux containing 25 wt. % of a fluoride containing aluminum and chlorides having about the same components as the above-mentioned chloride dry flux in thickness about 50 mm and maintained in the state for 1.5 min. Then, the washer was lifted up from the coating bath and subjected to treatment for control of a coating weight being adhered according to a centrifugal separation method, water cooled and dried.

In the coating treatment, 20 pieces of the washer having the above-mentioned size, put in a basket for coating were dipped in the coating bath and lifted up from the coating bath, and then vibrated for 3 sec and transferred to an apparatus for control of coating weight being adhered according to a centrifugal separation method to adjust a coating weight.

As a result, in all 20 pieces of the washer, Al—Zn alloy coated washers having no coating defects and presenting uniform and smooth appearance were obtained in a coating weight of 100 to 120 g/m$^2$ (average 112 g/m$^2$) per one side. Further, as a result of salt spray test (JIS-Z-2371) for the coated washers, in the test of 1,000 hr, no red rust from steel substrate due to coating defects was generated and only white rust from the coating layer was generated and coating performances were remarkably excellent.

Comparative Example 3

The washer prepared in the same manner as in Example 3 was subjected to pretreatment in the same manner as in Example 3, followed by coating of a flux being composed of (3 g/l calcium chloride-8 g/l potassium chloride-9 g/l sodium chloride) aqueous solution, i.e., a chloride flux solution containing 15 wt. % of calcium chloride in chlorides according to a spraying method and then heat drying treatment at 150° C. for 10 min, whereby a chloride dry flux coating film of an adhered amount of 1.0 g/m$^2$ per one side was formed on the washer.

Then, the thus treated washer was coated with a molten Al—Si alloy in the same manner and conditions in Example 3.

As a result, rust was generated in the course until the washer was dipped in the coating bath after the pretreatment since an adhered amount of the chloride dry flux was lacking, and in only function of the molten flux, cleaning and activating for the washer surface were not sufficient. In all 20 pieces of the washer, coating defects occurred in several places and coated appearance was very poor. As a result of salt spray test, in the test of 120 hr, a considerable amount of red rust from steel substrate due to non-coating layer was generated.

EXAMPLE 4

A nut (M22 size) prepared by overtapping a screw part for fitting a nut after hot-dip coating treatment to a bolt using sample steel A was degreased and water rinsed. Then, an oxide layer was removed by grit blast. Then, the thus treated nut was subjected to pretreatment of both activating treatment with a 10 wt. % hydrochloric acid aqueous solution and water rinsing, followed by coating of a flux being composed of a (40 g/l calcium chloride-40 g/l sodium chloride) aqueous solution, i.e., a chloride flux solution containing 50 wt. % of calcium chloride in chlorides according to a dipping method and then heat-drying treatment at 150° C. for 20 min, whereby a chloride dry flux coating film of an adhered amount 6.2 g/m$^2$ was formed on the nut.

Then, the thus treated nut was dipped in a molten Al-6% Si alloy coating bath of temperature 680° C. floated a molten flux being composed of contents of cryolite (15 wt. %)-aluminum fluoride (15 wt. %)-calcium chloride (35 wt. %)-sodium chloride (35 wt. %), i.e., a molten flux containing 30 wt. % of a fluoride containing aluminum and chlorides having about the same components as the above-mentioned chloride dry flux in thickness about 30 mm and maintained in the state for 1 min. Then, bolt was lifted up from the coating bath and subjected to treatment for control of a coating weight being adhered according to a centrifugal separation method, water cooled and dried.

In the coating treatment, 25 pieces of the nut having the above-mentioned size, put in a basket for coating were dipped in the coating bath and lifted up from the coating bath, and then vibrated for 10 sec and transferred to an apparatus for control of coating weight being adhered according to a centrifugal separation method to adjust a coating weight.

As a result, in all 25 pieces of the nut, Al—Zn alloy coated bolts having no coating defects and presenting uniform and smooth appearance were obtained in a coating weight of 90 to 115 g/m$^2$ (average 98.5 g/m$^2$). Further, as a result of salt spray test for the coated bolts, in the test of 750 hr, no red rust from steel substrate due to coating defects was generated and only white rust from the coating layer was generated and coating performances were remarkably excellent.

Comparative Example 4

The nut prepared in the same manner as in Example 4 was subjected to pretreatment and treatment with a chloride dry flux in the same manner as in Example 4, whereby a chloride dry flux coating film of an adhered amount of 6.2 g/m$^2$ was formed on the nut. Then, the thus treated nut was coated with a molten Al—Si alloy in the same manner and conditions as in Example 4 without using a molten flux.

As a result, coating defects including non-coating portion, adhesion of oxides, etc., remarkably occurred on the nut and coated appearance was very poor since there was little molten flux in the coating treatment and thus there were provided no effects including function to decompose oxides being produced in the coating bath, particularly aluminum oxide. As a result of salt spray test, in the test of 120 hr, red rust from steel substrate due to non-coating layer, etc., was remarkably generated.

EXAMPLE 5

A sample material having a shape of a line hardware (thickness 2.5 mm, width 50 mm, length 300 mm) prepared using sample steel B was degreased and water rinsed. Then, an oxide layer was removed. Then, thus treated sample material was subjected to pretreatment of both activating treatment with a 20 wt. % hydrochloric acid aqueous solution and rinsing with water, followed by coating of a flux being composed of a (60 g/l magnesium chloride-60 g/l potassium chloride-30 g/l lithium chloride) aqueous solution, i.e., a chloride flux solution containing 40 wt. % of magnesium chloride in chlorides according to a spraying method, whereby a chloride dry flux coating film of an adhered amount 10.1 g/m$^2$ per one side was formed on the sample material.

Then, the thus treated sample material was dipped in a molten Al-40% Zn-0.5%Si alloy coating bath of temperature 645° C. floated a molten flux being composed of contents of cryolite (50 wt. %)-magnesium chloride (20 wt. %)-potassium chloride (20 wt. %)-lithium chloride (10 wt. %), i.e., a molten flux containing 50 wt. % of a fluoride containing aluminum and chlorides having about the same components as the above-mentioned chloride dry flux in thickness about 40 mm and maintained in the state for 3 min. Then, the sample material was lifted up from the coating bath and subjected to treatment for control of a coating weight being adhered with high pressure nitrogen gas, and air cooled.

As a result, a coated layer of a coating weight 145 to 155 g/m$^2$ (average 150.5 g/m$^2$) was formed. Further, as a result of salt spray test for the coated sample material, in the test of 1,000 hr, no red rust from steel substrate due to coating defects was generated and only white rust from the coating layer was generated, and coating performances were remarkably excellent.

Comparative Example 5

The sample material prepared in the same manner as in Example 5 was subjected to pretreatment and treatment with a chloride dry flux in the same manner as in Example 5, whereby a chloride dry flux coating film of an adhered amount of 10.1 g/m$^2$ per one side was formed on the sample material.

Then, the thus treated sample material was dipped in a molten Al-40% Zn-0.5% Si alloy coating bath of temperature 645° C. floated a molten flux being composed of contents of magnesium chloride (40 wt. %)-potassium chloride (40 wt. %)-lithium chloride (20 wt. %), i.e., a molten flux having about the same components as the above-mentioned chloride dry flux in thickness about 40 mm and maintained in the state for 3 min. Then, the sample material was lifted up from the coating bath and subjected to treatment for control of coating weight being adhered with high pressure nitrogen gas, and air cooled.

As a result, coating defects including non-coating portion, adhesion of oxides, etc., remarkably occurred on the sample material and coated appearance was very poor since there were not provided sufficient effects including function to decompose oxides being produced in the coating bath, particularly aluminum oxide. As a result of salt spray test, in the test of 120 hr, red rust from steel substrate due to non-coating layer, etc., was remarkably generated.

EXAMPLE 6

A sample material in a shape of round bar (25 mmϕ, 250 mm) having a screw part at regular intervals prepared using sample steel D was degreased and water rinsed. Then, an oxide layer on the surface was removed with a (10% $H_2SO_4$+3% HF) aqueous solution. Then, the thus treated sample material was subjected to pretreatment of both activating treatment with a 7.5 wt. % hydrochloric acid aqueous solution and water rinsing, followed by coating of a flux being composed of a (45 g/l calcium chloride-70 g/l potassium chloride-35 g/l sodium chloride) aqueous solution, i.e., a chloride flux solution containing 30 wt. % of calcium chloride in chlorides according to a dipping method and then heat drying treatment at 200° C. for 10 min, whereby a chloride dry flux coating film of an adhered amount 18.5 g/m$^2$ was formed on the sample material.

Then, the thus treated sample material was dipped in a molten Al-0.3% Mn-10% Si alloy coating bath of temperature 650° C. floated a molten flux being composed of contents of cryolite (15 wt. %)-aluminum fluoride (25 wt. %)-calcium chloride (20 wt. %)-potassium chloride (25 wt. %)-sodium chloride (15 wt. %), i.e., a molten flux containing 40 wt. % of a fluoride containing aluminum and chlorides having the same species as in the above-mentioned chloride dry flux and different components from the dry flux in thickness about 25 mm and maintained in the state for 3 min. Then, the sample material was lifted up from the coating bath and subjected to treatment for control of a coating weight being adhered according to a centrifugal separation method, water cooled and dried.

In the coating treatment, 5 pieces of the round bar having the above-mentioned size, put in a basket for coating were dipped in the coating bath, and lifted up from the coating bath, and then vibrated for 3 sec, transferred to an apparatus for control of coating weight being adhered according to a centrifugal separation method to adjust a coating weight.

As a result, in all 5 pieces of the round bar, a Al—Si alloy coated layer having no coating defects and presenting uniform and smooth appearance were formed in a coating weight of 95 to 120 g/m$^2$ (average 115 g/m$^2$). Further, as a result of salt spray test for the coated sample material, in the test of 1,000 hr, no red rust from steel substrate due to coating defects was generated and only white rust from the coating layer was generated and coating performances were remarkably excellent.

Comparative Example 6

The sample material prepared in the same manner as in Example 6 was subjected to pretreatment and treatment with a chloride dry flux in the same manner as in Example 6, whereby a chloride dry flux coating film of an adhered amount of 18.5 g/m$^2$ was formed on the sample material.

Then, the thus treated sample material was dipped in a molten Al-0.3% Mn-10% Si alloy coating bath of temperature 660° C. floated a molten flux being composed of components of sodium fluoride (5 wt. %)-lithium fluoride (3 wt. %)-calcium chloride (27.6 wt. %)-potassium chloride (42.9 wt. %)-sodium chloride (21.5 wt. %), i.e., a molten flux containing 8 wt. % of fluoride containing no aluminum and chlorides having about the same components as the above-mentioned chloride dry flux in thickness about 25 mm and maintained in the state for 3 min. Then, the sample material was lifted up from the coating bath and subjected to treatment for control of coating weight being a adhered in the same manner as in Example 6, water cooled and dried.

As a result, coating defects including non-coating portion, adhesion of oxides, etc., remarkably occurred on the sample material and coated appearance was very poor since there were not provided sufficient effects including function to decompose oxides being produced in the coating bath, particularly aluminum oxide. As a result of salt spray test, in the test of 120 hr, red rust from steel substrate, etc., was remarkably generated.

EXAMPLE 7

A sample material having a shape of line hardware (thickness 5.5 mm, width 50 mm, length 300 mm) prepared using a hot-rolled sheet steel (corresponding to S40C) was degreased and water rinsed. Then, an oxide layer on the sample material was removed by acid pickling with a 10 wt. % $H_2SO_4$ aqueous solution, and the thus treated sample material was subjected to water rinsing and drying. Then, average roughness of the sample material surface was adjusted to 3.0 $\mu$mRa (measured by JIS B 0601-1982, surface texture, measuring instrument; Tokyo Precision Co, Ltd) by grit blast, and the thus treated sample material was subjected to pretreatment of both activating treatment with a 10 wt. % HCl aqueous solution and water rinsing treatment, followed by coating of a chloride flux solution being composed of a (38 g/l calcium chloride-108 g/l potassium chloride-54 g/l sodium chloride) aqueous solution according to a dipping method and heat drying treatment at 100° C. for 15 min, whereby a chloride dry flux coating film of an adhered weight of 11.8 g/m$^2$ per one side was formed to conduct aqueous dry flux treatment.

Then, the thus treated sample material was dipped in a molten Al-43.5% Zn-1.5% Si alloy coating bath floated a molten flux being composed of contents of cryolite (15 wt. %)-aluminum fluoride (30 wt. %)-calcium chloride (10 wt. %)-potassium chloride (30 wt. %)-sodium chloride (15 wt. %) in thickness about 20 mm and further added 0.35 wt. % of an iron component at coating temperature 635° C., and maintained in the state for 2 min.

Then, while the sample material was lifted up from the coating bath at a velocity of 2 m/min, excess molten metal adhered to the sample material was wiped off to conduct treatment for control of a coating weight being adhered with nitrogen gas and the coated sample material was water cooled and dried, whereby a molten Al—Zn alloy coated layer was formed on the sample material.

As a result, 4 to 6 pieces per surface area 1 m$^2$ of minute protrusion due to partial stagnation of oxides and the molten metal were merely generated on the coated layer surface. The coating weight was 230 g/m$^2$ per surface area. The stagnate portion of the coating metal generated at the lower end portion during treatment for control of a coating weight was ground to remove. The coating weight is shown by an average value measured in the smooth portion except the stagnant portion.

Thus, treatment for control of a coating weight being adhered was conducted in the state adhered a large amount of the molten coating metal to the sample material according to the present process. As a result, a molten Al—Zn alloy coated layer presenting uniform and smooth coated appearance could be formed in a heavy coating weight on the sample material.

Comparative Example 7

An oxide layer on the sample material prepared by the same manner as in Example 7 was removed with a $H_2SO_4$ aqueous solution in the same conditions as in Example 7. The thus treated sample material was subjected to pretreatment of both activating treatment with a HCl solution and water rinsing, followed by aqueous dry flux treatment with the chloride flux in the same manner as in Example 7.

Then, the thus treated sample material was dipped in a molten Al-43.5% Zn-1.5% Si alloy coating bath floated a molten flux having the same components as in Example 7 and containing 0.04 wt. % of an iron component at coating temperature 635° C. as an inevitable impurity and maintained in the state for 2 min. Then, the sample material was lifted up from the molten coating bath at a velocity of 2 m/min, and without conducting treatment for control of a coating weight being adhered based on wiping treatment of a molten coating metal adhered to the sample material and brought, immediately water cooled and dried, whereby a coated layer was formed on the sample material.

As a result, 8 to 10 pieces per surface area 1 m$^2$ of minute protrusion due to oxides and partial stagnation of the molten coating metal was generated on the coated layer surface. The coating weight was 70 g/m$^2$ per surface area.

Thus, surface roughness of the sample material merely removed an oxide layer with a $H_2SO_4$ aqueous solution as described above, was 0.95 $\mu$mRa. Furthermore, since fluidity of the molten coating metal was very large due to no addition of an iron component, the amount of the molten coating metal adhered to the sample material and maintained after lifting up from the coating bath was small and it was difficult to form a coated layer with a heavy coating weight, although treatment for control of a coating weight being adhered was not conducted.

EXAMPLE 8

A bolt (M20, 75 mm) prepared using sample steel A was degreased and water rinsed. Then, an oxide layer on the bolt was removed by grit blast and average roughness of the sample material surface was adjusted to 5.3 $\mu$mRa by grit blast, and the thus treated bolt was subjected to pretreatment of both activating treatment with a 10 wt. % HCl aqueous solution and water rinsing treatment, followed by coating of a chloride flux solution being composed of a (45 g/l calcium chloride-70 g/l potassium chloride-35 g/l sodium chloride) aqueous solution according to a dipping method and heat drying treatment at 150° C. for 20 min, whereby a chloride dry flux coating film of an adhered amount of 15.5 g/m$^2$ was formed to conduct aqueous dry flux treatment.

Then, the thus treated bolt was dipped in a molten Al-44.0% Zn-1.0% Si alloy coating bath floated a molten flux being composed of contents of aluminum fluoride (45 wt. %)-calcium chloride (16.5 wt. %)-potassium chloride (25.7 wt. %)-sodium chloride (12.8 wt. %) in thickness about 30 mm and further added 0.55 wt. % of an iron component at coating temperature 640° C., and maintained in the state for 3 min.

Then, the dipped bolt was lifted up from the coating bath and subjected to treatment for control of a coating weight being adhered with a centrifugal separation, water cooled and dried.

In the coating treatment and the treatment for control for a coating weight being adhered, 15 pieces of the bolt having the above-mentioned size subjected to chloride aqueous flux treatment, put in a basket for coating were dipped in the coating bath.

Then, the basket was lifted up from the coating bath at a velocity of 5.4 m/min, and then the bolts were shifted to a basket for control of a coating weight being adhered, provided with a centrifugal separator and immediately, excess molten coating metal adhered to the bolts was wiped off by rotating treatment with the centrifugal separator at a circumferential speed of 750 m/min for 5 sec to conduct the treatment for control of a coating weight being adhered.

As a result, 3 to 4 pieces of very minute protrusion due to stagnation of the molten coating metal was generated in one row toward a vertical direction in the screw part of the bolt since all bolts were subjected to the treatment for control of a coating weight being adhered in the state adhered a large amount of the molten coating metal, but Al—Zn coated layer with a heavy coating weight presenting comparatively uniform and smooth appearance was formed in a coating weight of 375 to 392 g/m$^2$ (average 381 g/m$^2$).

Comparative Example 8

An oxide layer on the bolt prepared in the same manner as in Example 8 was removed by grit blast under the same conditions as in Example 8 and surface roughness was adjusted in the same manner as in Example 8. The thus treated bolt was subjected to activating treatment with a HCl aqueous solution and water rinsing treatment, followed by aqueous dry flux treatment in the same manner as in Example 8.

Then, the thus treated bolt was dipped in a molten Al-44.0% Zn-1.0% Si alloy coating bath floated a molten flux having the same components as in Example 8 and containing 0.1 wt. % of an iron component at coating temperature 640° C. and maintained in the state for 3 min. Then, the bolt was lifted up from the molten coating bath, and subjected to treatment for control of a coating weight being adhered with a centrifugal separator in the same manner as in Example 8, water cooled and dried, whereby the comparative sample bolt was prepared.

As a result, in all 15 pieces of the bolt, very minute protrusion due to stagnation of the molten coating metal were generated in the same state as in Example 8 and a coated layer presenting comparatively uniform and smooth coating appearance was formed, but the coating weight was merely 80 to 102 g/m$^2$ (average 90 g/m$^2$).

Thus, the surface roughness of the bolt was adjusted to the same 5.3 $\mu$mRa as in Example 8. However, since the weight of an iron component being added to the molten coating bath was small and fluidity of the molten coating bath was very large, the weight of the molten coating metal adhered and maintained to the bolt after lifting up from the coating bath was small and it was difficult to form a coated layer with a heavy coating weight.

EXAMPLE 9

For the bolt prepared in the same manner as in Example 8, removal of oxide layer, adjustment of surface roughness and activating treatment were conducted in the same manner and conditions as in Example 8, followed by chloride aqueous dry flux treatment in the same manner as in Example 8.

Then, the thus treated bolt was subjected to hot-dip coating treatment in a molten Al—Zn—Si alloy coating bath added the same flux and iron component as in Example 8 in the same manner and conditions in Example 8.

Then, the basket for coating, put 15 pieces of the bolt therein was lifted up from the coating bath at a velocity of 5.4 m/min, and then the bolts were shifted to a basket for control of a coating weight being adhered, provided with a centrifugal separator, and in the same manner as in Example 8, excess molten coating metal adhered to the bolts was wiped off by rotating treatment with the centrifugal separator at a circumferential speed of 750 m/min for 5 sec to conduct the treatment for control of a coating weight being adhered, and then immediately the thus coated bolts were subjected to smoothing treatment according to rotating treatment in a reverse direction at a circumferential speed of 375 m/min (½ to said circumferential speed) for 3 sec (⅗ to said treating time), water cooled and dried.

As a result, since in all the bolts were subjected to the treatment for control of a coating weight being adhered and smoothing treatment in the state adhered and maintained a large weight of the molten coating metal, Al—Zn coated layer with a heavy coating weight presenting uniform and smooth appearance was formed in a coating weight of 368 to 382 g/m$^2$ (average 375 g/m$^2$).

Comparative Example 9

The bolt prepared in the same manner as in Example 8 was degreased, water rinsed and dried, and an oxide layer on the bolt was removed by grit blast and surface roughness of the blot was adjusted to average roughness 1.8 $\mu$mRa. The thus treated bolt was subjected to activating treatment with a 10 wt. % HCl aqueous solution and water rinsed, followed by chloride aqueous dry flux treatment in the same manner as in Example 8.

Then, the thus treated bolt was dipped in a molten Al-44.0% Zn-1.0% Si alloy coating bath floated a molten flux having the same components as in Example 9 and containing 0.55 wt. % of an iron component at coating temperature 635° C. and maintained in the state for 3 min, and lifted up from the coating bath at a velocity of 5.4 m/min and subjected to treatment for control of a coating weight being adhered and smoothing treatment in the same conditions as in Example 9, water cooled and dried, whereby the comparative sample bolt was prepared.

As a result, in all the bolts, a coated layer presenting an uniform and smooth coated appearance was formed, but the coating weight was merely 118 to 135 g/m$^2$ (average 120 g/m$^2$).

Thus, although there was used the same molten coating bath as in Example 9 wherein an iron component was molten and added to increase sufficiently viscosity, average roughness of the bolt surface subjected to adjustment treatment for surface roughness was 1.8 $\mu$mRa, so that the weight of the molten coating metal being brought out in lifting up from the coating bath was small and it was difficult to form a coated layer with a heavy coating weight.

EXAMPLE 10

A nut (M22 size) prepared by overtapping a screw part for fitting a nut after hot-dip coating treatment to a bolt using the same material as in Example 8 was degreased, water rinsed and dried. Then an oxide layer on the nut was removed by grit blast and the surface roughness of exterior, upper surface and lower surface of the nut was adjusted to average roughness 3.5 μmRa, and the thus treated nut was subjected to pretreatment of both activating treatment with a 10 Wt.% HCl aqueous solution and water rinsing treatment, followed by coating of a chloride flux solution being composed of a (40 g/l calcium chloride-20 g/l potassium chloride-20 g/l sodium chloride) aqueous solution according to a dipping method and heat drying treatment at 180° C. for 15 min, whereby a chloride dry flux coating film of an adhered weight of 6.4 g/m$^2$ was formed to conduct aqueous dry flux treatment.

Then, a basket for coating, put the thus treated 20 pieces of the nut therein, was dipped in a molten Al-38% Zn-1.8% Si alloy coating bath floated a molten flux being composed of contents of cryolite (20 wt. %)-aluminum fluoride (30 wt. %)-calcium chloride (20 wt. %)-potassium chloride (25 wt. %)-sodium chloride (12.5 wt. %) in thickness about 15 mm and further added 0.85 wt. % of an iron component at coating temperature 645° C. and maintained in the state for 3 min.

Then, the basket was lifted up from the coating bath at a velocity 8.5 m/min and vibrated for 10 sec, and then the nuts were shifted to a basket for control of a coating weight being adhered, provided with a centrifugal separator, and immediately, excess molten coating metal adhered to the nuts was wiped off by rotating treatment with the centrifugal separator at a circumferential speed of 940 m/min for 5 sec to conduct the treatment for control of a coating weight being adhered. Further, immediately the nuts were subjected to smoothing treatment comprising rotating in a reverse direction at a circumferential speed of 565 m/min (3/5 to said circumferential speed) for 3 sec (3/5 to said treating time). Thus the nuts were continuously subjected to both rotating wiping treatment and rotating smoothing treatment three times under the above-mentioned conditions, water cooled and dried.

As a result, since all the nuts were subjected to both treatment for control of a coating weight being adhered and smoothing treatment in the state adhered and maintained a large of the molten coating metal, Al—Zn coated layer with a heavy coating weight presenting uniform and smooth coated appearance was formed in a coating weight of 285 to 303 g/m$^2$ (average 292 g/m$^2$) in the exterior, upper surface and lower surface of the nut, and 310 to 321 g/m$^2$ (average 316 g/m$^2$) in the interior screw part of the nut.

Comparative Example 10

The nut prepared in the same manner as in Example 10 was degreased, water rinsed and dried. Then, an oxide layer on the nut was removed by grit blast and surface roughness of the nut, particularly exterior, upper surface and lower surface of the nut was adjusted to average roughness 2.2 μmRa. The thus treated nut was subjected to activating treatment with a 10 wt. % HCl aqueous solution and water rinsed.

Then, the thus treated nut was dipped in a molten Al-38% Zn-1.8% Si alloy coating bath floated a molten flux having the same components as in Example 10 in thickness about 15 mm and containing 0.18 wt. % of an iron component of treatment of temperature 645° C. and maintained in the state for 3 min. Then, the nut was lifted up from the molten coating bath, at a velocity of 8.5 m/min and vibrated for 10 sec and subjected to both treatment for control of a coating weight being adhered and smoothing treatment with a centrifugal separator in the same manner as in Example 10, water cooled and dried, whereby the comparative sample nut was prepared.

As a result, in all the nuts, a coated layer presenting uniform and smooth coated appearance was formed, but the coating weight was 90 to 112 g/ml (average 103 g/m$^2$) in the exterior, upper surface and lower surface of the nut. Thus, since the effect for adhering sufficiently and maintaining a large amount of the molten coating metal to the nut after lifting up from the coating bath was not provided in the adjustment of surface roughness and the weight of an iron component being added to the molten coating bath under this treating conditions, it was difficult to form a coated layer with a heavy coating weight on the exterior, upper surface and lower surface of the nut.

EXAMPLE 11

A bolt (M24×150 mm) prepared using a low alloy steel (corresponding to high tensile strength 80 kg/mm$^2$ class) was degreased and water rinsed. Then an oxide layer on the bolt was removed by grit blast. Then, average roughness of the bolt surface was adjusted to 3.9 μmRa, and the thus treated bolt was subjected to activating treatment with 15 wt. % HCl aqueous solution and water rinsing treatment, followed by coating of a chloride flux solution being composed of a (30 g/l calcium chloride-10 g/l magnesium chloride-80 g/l potassium chloride-80 g/l sodium chloride) aqueous solution according to a dipping method and heat drying treatment at 150° C. for 15 min, whereby a chloride dry flux coating film of an adhered amount 17.8 g/m$^2$ was formed to conduct aqueous dry flux treatment.

Then, 10 pieces of the nut, put in a basket for coating were dipped in a molten Al-8.5% Si alloy coating bath floated a molten flux being composed of contents of cryolite (20 wt. %)-aluminum fluoride (20 wt. %)-calcium chloride (9 wt. %)-magnesium chloride (3 wt. %)-potassium chloride (24 wt. %)-sodium chloride (24 wt. %) in thickness about 40 mm and further added 1.1 wt. % of an iron component at coating temperature 660° C. and maintained in the state for 2 min.

Then, the basket was lifted up from the coating bath at a velocity of 7.5 m/min, and then the bolts were shifted to a basket for control of a coating weight being adhered, provided with a centrifugal separator, and immediately, excess molten coating metal adhered to the bolts was wiped off by rotating treatment with the centrifugal separator at a circumferential speed of 470 m/min for 6 sec and subjected to rotating-smoothing treatment in a reverse direction at a circumferential speed of 188 m/min (2/5 to said circumferential speed) for 2 sec (1/3 to said treating time), water cooled and dried.

As a result, since all the bolts were subjected to both treatment for control of a coating weight being adhered and smoothing treatment in the state adhered and maintained a large amount of the molten coating metal, Al—Si alloy coated layer with a heavy coating weight presenting an uniform and smooth coated appearance was formed in a coating weight of 187 to 209 g/m$^2$ (average 201 g/m$^2$).

Comparative Example 11

The bolt prepared in the same manner as in Example 11 was degreased, water rinsed and dried. An oxide layer on the bolt was removed with a 20 wt. % $H_2SO_4$ aqueous solution and water rinsed. The thus treated bolt was subjected to activating treatment with a 15 wt. % HCl aqueous solution and water rinsed, followed by treatment with chloride aqueous dry flux having the same components as in Example 11.

Then, the thus treated bolt was dipped in a molten Al-8.5% Si alloy coating bath floated a molten flux having the same components as in Example 11 and further added 1.1 wt. % of an iron component at coating temperature 660° C. in thickness about 40 mm and maintained in the state for 2 min. Then, the bolt was lifted up from the coating bath and then subjected to treatment for control of a coating weight being adhered and smoothing treatment, water cooled and dried, whereby the comparative sample bolt was prepared.

As a result, in all the bolts, a coated layer presenting uniform and smooth coated appearance was formed, but the coating weight was 85 to 115 g/m$^2$ (average 95 g/m$^2$). Thus, although there was used the same molten coating bath as in Example 11 wherein an iron component was molten and added to increase sufficiently viscosity, no adjustment treatment for surface roughness was conducted, so that average roughness of the bolt surface was 1.2 $\mu$mRa and the amount of the molten coating metal being brought out in lifting up from the coating bath was small and it was difficult to form a coated layer with a heavy coating weight.

TABLE 1

| | Main chemical content (% by weight) | | | | | | | |
|---|---|---|---|---|---|---|---|---|
| Sample steel | C | Si | Mn | P | S | Cr | Mo | Other particular element |
| A | 0.39 | 0.20 | 0.72 | 0.019 | 0.025 | 0.05 | trace | |
| B | 0.20 | 0.17 | 0.78 | 0.020 | 0.006 | 0.37 | trace | |
| C | 0.40 | 0.30 | 0.55 | 0.040 | 0.003 | 1.00 | 0.60 | V; 0.30 |
| D | 0.12 | 0.12 | 0.30 | 0.013 | 0.010 | 12.90 | 0.26 | Ti; 0.15 |

What is claimed is:

1. A process for hot dip-coating a steel material with a molten aluminum alloy according to a one-stage metal alloy coating method using a flux, wherein said method consists essentially of:

removing an oxide layer which is present on a steel material surface, conducting activating treatment for the steel material surface, and (i) coating the steel material surface with a chloride flux solution consisting essentially of (a) at least one chloride selected from the group consisting of calcium chloride and magnesium chloride and (b) at least one chloride selected from the group consisting of potassium chloride, lithium chloride and sodium chloride and then drying the steel material surface, thereby forming a coating film of a dried chloride flux in an adhered amount of 1.5 g/m$^2$ to 30 g/m$^2$ on the steel material wherein the content of (i)(a) chloride flux component selected from the group consisting of calcium chloride and magnesium chloride, based on total weight of the chloride flux solution, satisfies the following range:

$$5\% \text{ by weight} \leqq \text{content } (a)/\{\text{content } (a)+\text{content } (b)\}\times 100 \leqq 70\% \text{ by weight}$$

and (ii) then, dipping the thus treated steel material in a molten aluminum alloy coating bath containing a floating, molten fluoride-containing flux consisting essentially of (c) a fluoride containing aluminum, (d) at least one chloride selected from the group consisting of calcium chloride and magnesium chloride and (e) at least one chloride selected from the group consisting of potassium chloride, lithium chloride and sodium chloride, wherein the content of (ii) (c) fluoride-containing aluminum, based on total weight of the fluoride-containing flux, satisfies the following range:

$$15\% \text{ by weight} \leqq \text{content } (c)/\{\text{content } (c)+\text{content } (d)+\text{content } (e)\}\times 100 \leqq 60\% \text{ by weight}$$

thereby coating the steel material surface with aluminum alloy.

2. A process for hot dip-coating a steel material with a molten aluminum alloy according to a one-stage metal alloy coating method using a flux, wherein said method consists essentially of:

removing an oxide layer which is present on a steel material surface, adjusting an average roughness of the steel material surface to the range of 2.5 to 7.5 $\mu$mRa, conducting activating treatment for the steel material surface,

(1) coating the steel material surface with a chloride flux solution consisting essentially of (a) at least one chloride selected from the group consisting of calcium chloride and magnesium chloride and (b) at least one chloride selected form the group consisting of potassium chloride, lithium chloride and sodium chloride and then drying the steel material surface, thereby forming a coating film of a dried chloride flux in an adhered amount of 1.5 g/m$^2$ to 30 g/m$^2$ on the steel material, wherein the content of (i) (a) chloride flux component selected from the group consisting of calcium chloride and magnesium chloride, based on total weight of the chloride flux solution, satisfies the following range:

$$5\% \text{ by weight} \leqq \text{content } (a)/\{\text{content } (a)+\text{content } (b)\}\times 100 \leqq 70\% \text{ by weight}$$

(ii) then, dipping the thus treated steel material in a molten aluminum alloy coating bath containing a floating, molten fluoride-containing flux consisting essentially of (c) a fluoride containing aluminum, (d) at least one chloride selected from the group consisting of calcium chloride and magnesium chloride and (e) at least one chloride selected from the group consisting of potassium chloride, lithium chloride and sodium chloride, wherein an iron component of 0.25 to 1.5% by weight to the total weight of the molten alloy metal except the flux has been added to the coating bath and the content of (ii) (c) fluoride-containing aluminum, based on total weight of the fluoride-containing flux, satisfies the following range:

$$15\% \text{ by weight} \leqq \text{content } (c)/\{\text{content } (c)+\text{content } (d)+\text{content } (a)\}\times 100 \leqq 60\% \text{ by weight}$$

and then, conducting treatment for control of coating weight, thereby coating the steel material surface with the molten aluminum alloy to adhere an amount thereof to the steel material surface.

3. The process for hot dip-coating according to claim 2, wherein the treatment for control of coating weight is conducted according to a centrifugal separation method employing a circumferential speed of 400 to 1,500 m/min.

4. The process for hot dip-coating according to claim 2, wherein the treatment for control of coating weight is conducted for a treating time $t_o$ according to a centrifugal separation method employing a circumferential speed $V_0$ of 400 to 1,500 m/min and then conducting a smoothing treatment at a circumferential speed $V_1$ of from ⅓ to ⅘ of said circumferential speed $V_0$ for a treating time $t_1$ of from ⅕ to ¾of said treating time $t_0$ by conducting rotation in the reverse direction to that in said centrifugal separation method.

* * * * *